United States Patent [19]

Berkowitz

[11] Patent Number: 4,484,462

[45] Date of Patent: Nov. 27, 1984

[54] REMOVABLE CYLINDER LOCK

[75] Inventor: Irving L. Berkowitz, Binghamton, N.Y.

[73] Assignee: Kason Industries, Inc., Binghamton, N.Y.

[21] Appl. No.: 374,579

[22] Filed: May 3, 1982

[51] Int. Cl.[3] ..... E05B 29/02

[52] U.S. Cl. ..... 70/368; 70/224

[58] Field of Search ..... 70/368, 367, 215, 217, 70/224

[56] References Cited

U.S. PATENT DOCUMENTS

| | | | |
|---|---|---|---|
| 1,761,092 | 6/1930 | Shinn | 70/368 |
| 2,150,639 | 3/1939 | Simon | 70/368 |
| 3,434,316 | 3/1969 | Neary | 70/368 |
| 3,526,111 | 9/1970 | Jacobi | 70/368 |
| 4,095,445 | 6/1978 | Storlie | 70/215 |
| 4,380,915 | 4/1983 | Kincaid | 70/224 |

*Primary Examiner*—Robert L. Wolfe

*Attorney, Agent, or Firm*—Paul J. Sutton

[57] ABSTRACT

A lock assembly features a removable cylinder plug. The cylinder plug is rotatably disposed in an outer body portion of the lock assembly that is itself movably positionable in a lock housing. The removable plug is only removable when the outer body portion of the assembly is disengaged from the housing. The body portion is disengageable when the inner plug member is rotated within the body portion after insertion of a key.

3 Claims, 15 Drawing Figures

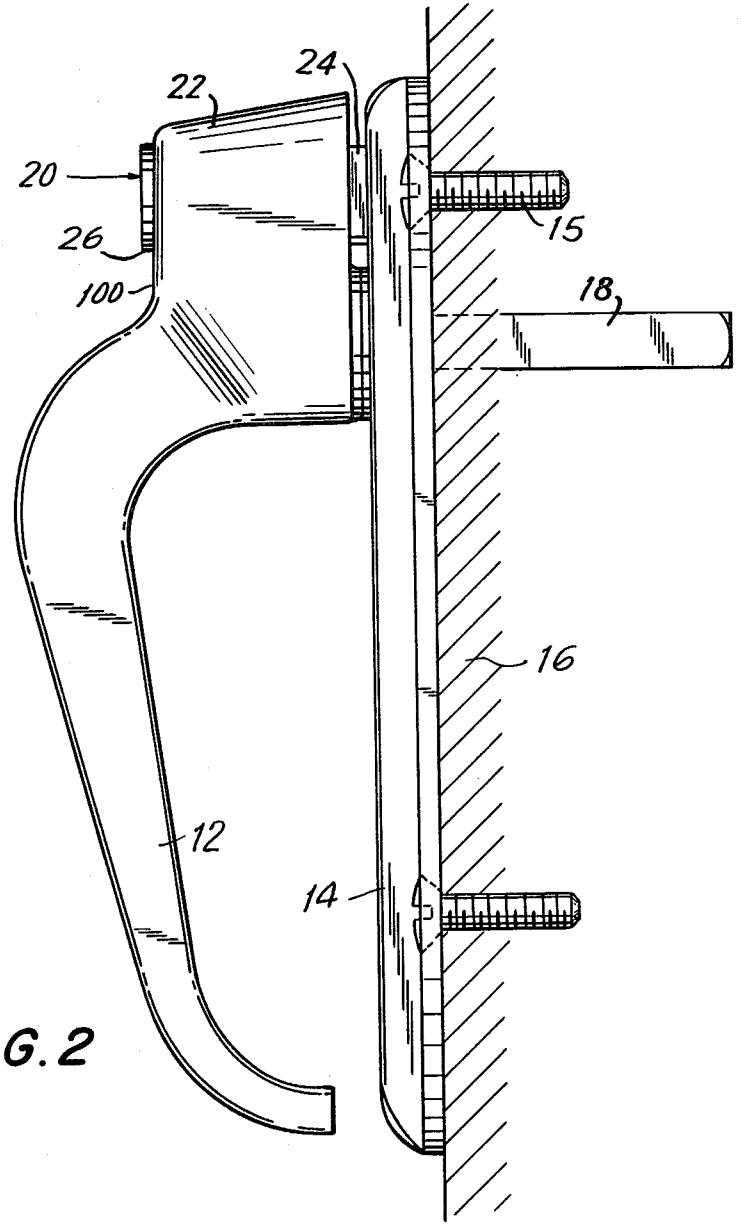
FIG. 2
FIG. 1
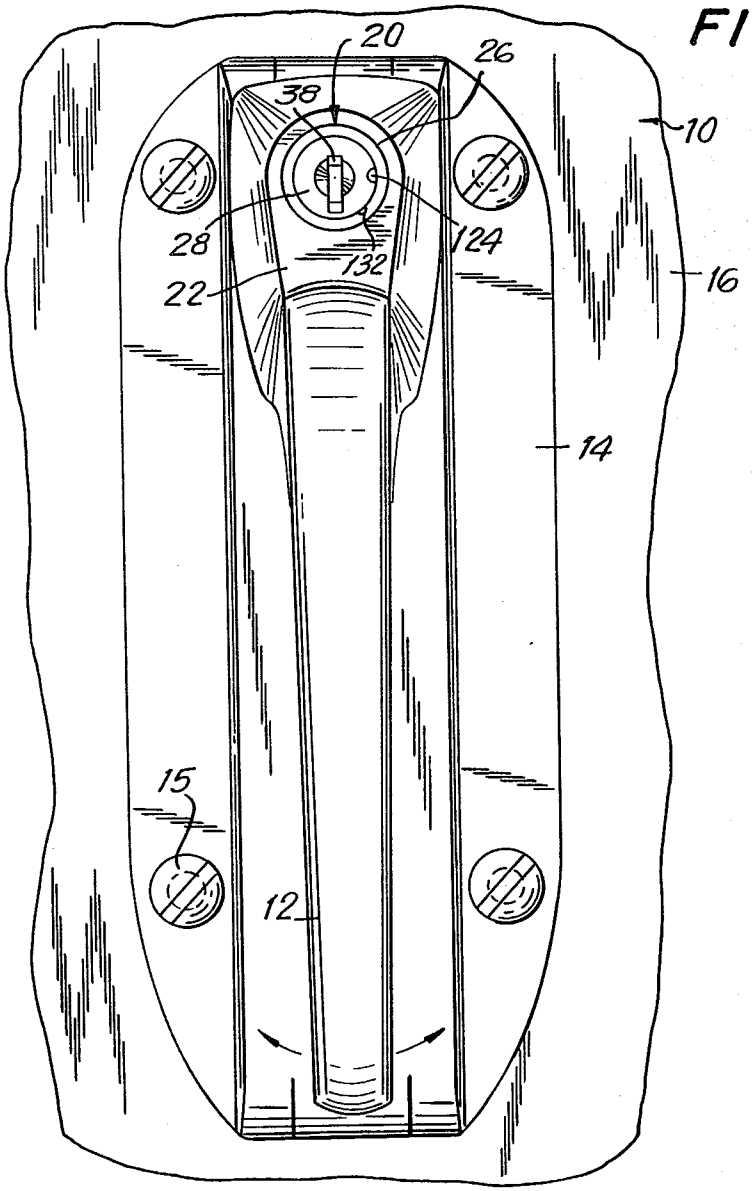

FIG. 9
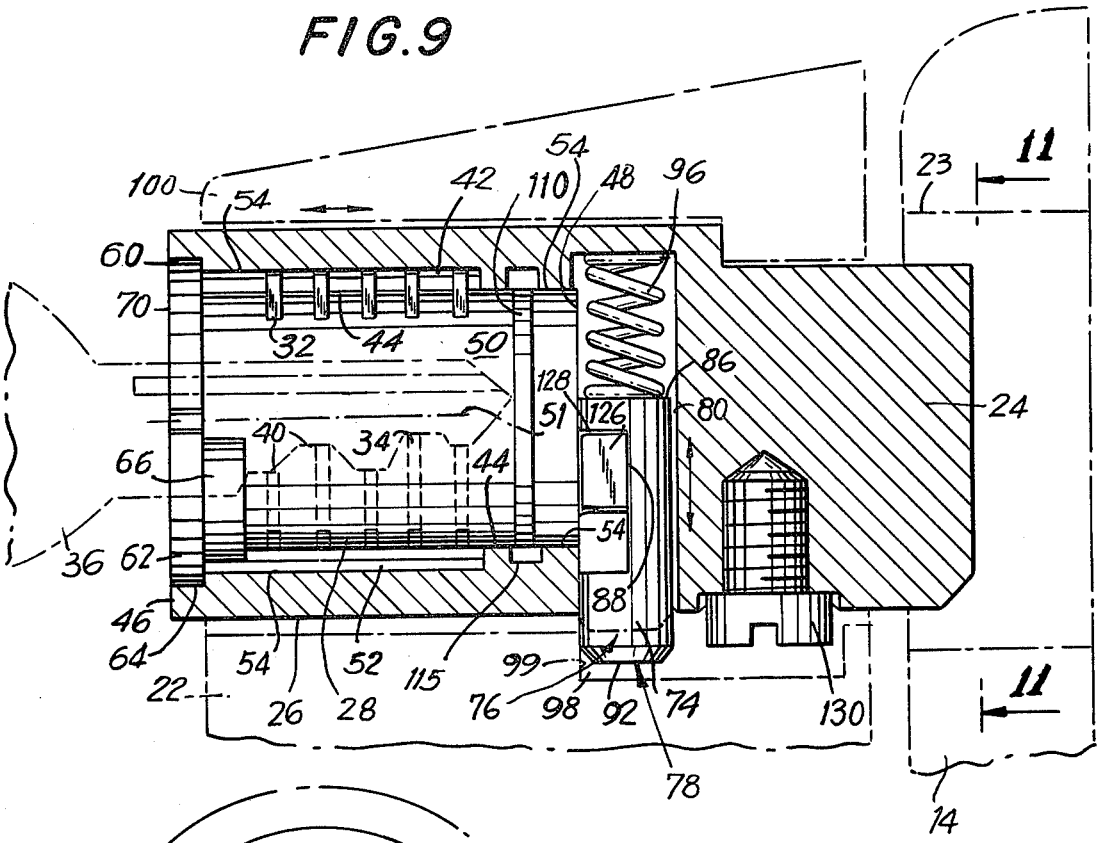
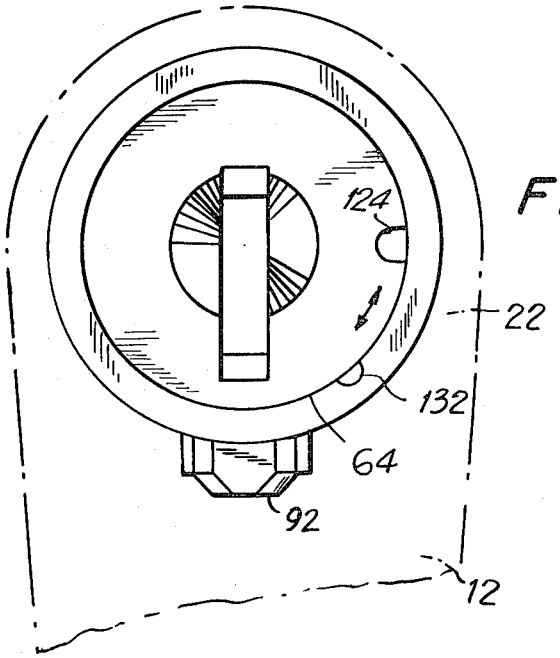
FIG. 10
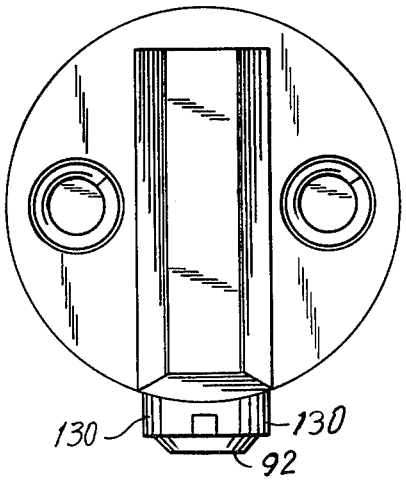
FIG. 11

REMOVABLE CYLINDER LOCK

The present invention relates generally to the art of cylinder locks and more particularly to a cylinder lock having a plug that can be removed from the cylinder body when the lock is not needed for guarding purposes.

One of the primary security problems of large operations involving a large number of identical but separate storage chambers that contain goods that need to be guarded is that of the security of the keys to the locks. In addition to the security problems, the problems of keeping track of the keys, lost keys, and the need to break locks to gain access are involved. Having separate, removable padlocks has been to traditional response, but many locks are not adaptable to padlocks. One such typical lock is the cylinder lock of panel trucks; padlocks cannot ordinarily be used in such a case.

Many organizations have fleets of such trucks and, in a typical scenario, the trucks are parked in a large yard at night and the drivers turn in their keys. The next morning the drivers are assigned to new trucks and keys for the panel locks are provided. Both the security problems and the organization problems can result in delays, losses, and expenses of breaking and repair work.

Another method of avoiding key loss and security problems is the combination lock. These locks, however, also provide even greater security problems in a mass operation, are not inexpensive, and are cumbersome when quickness of opening the locked door is desired.

The present invention interplays the elimination of most of these limitations of the present state of the art by providing a level key activated cylinder lock assembly.

Accordingly, it is an object of this invention to provide a simple, inexpensive key activated cylinder lock assembly having a plug that can be removed from the cylinder body.

It is a further object of this invention to provide a cylinder lock having a plug for a cylinder lock assembly having a retractable retaining member that engages a circular track around the inside of the cylinder body.

It is a further object of this invention to provide a retractable retaining member for a plug for a key activated cylinder lock that can be pressed back from a retaining track via a wire track so that the plug can be removed from the cylinder body.

It is yet another object of this invention to provide a cylinder plug having a retractable retaining member for holding the plug in the cylinder body and it provides means in the cylinder body for retracting the retaining member when the plug is being inserted into the cylinder body.

It is yet a further object of this invention to provide a key activated cylinder lock assembly for a handle retractably connected to a plate mounted on a door with a cylinder plug that can be removed from the cylinder plug by a wire tool being inserted into a channel in the cylinder assembly.

It is a further object of the present invention to provide a key activated cylinder lock assembly with a removable cylinder plug having a retractable retaining member at the inner end of the plug that can be pried into a retracted position via a wire tool inserted into a tool receiving channel in the cylinder lock.

It is a further object of this invention to provide a removable cylinder plug for a key activated cylinder lock having a key on the plug inner end wall that raises a locking pin of the cylinder lock assembly that releases a locking means for locking a handle to a door-mounted plate.

It is yet a further object of this invention to provide an inexpensive, easily operated removable cylinder plug for a key activated cylinder lock that can be quickly and simply removed from the cylinder body via a wire tool.

The present invention fulfills the above objects and overcomes the limitations and disadvantages of the prior art.

This invention will be more clearly understood from the following description of specific embodiments of the invention together with the accompanying drawings, wherein similar reference characters denote similar elements throughout the several views, and in which:

FIG. 1 is a fragmentary frontal elevational view of the cylinder lock assembly mounted in a handle connected to a plate secured to a door.

FIG. 2 is a fragmentary side view of the handle and cylinder lock in a locked position.

FIG. 9 shows the sectional view of line 9—9 of FIG. 8 with the inserted key shown in phantom lines.

FIG. 10 shows the outer end view of FIG. 9.

FIG. 11 shows the opposite and sectional view when along line 11—11 in FIG. 9.

Figure 3:
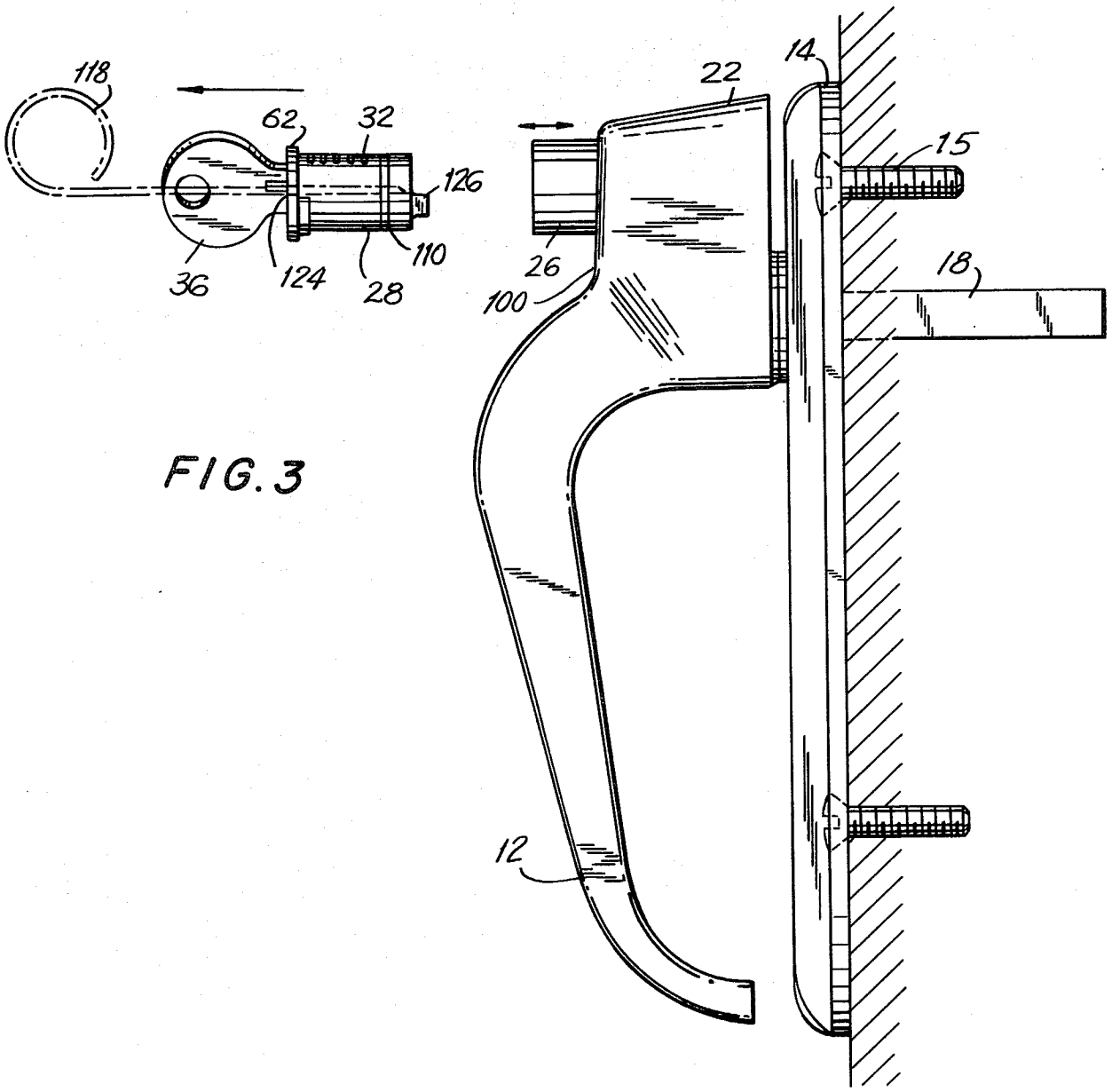
FIG. 3 shows the lock in an unlocked position with the cylinder plug removed from the cylinder body.
Figure 4:
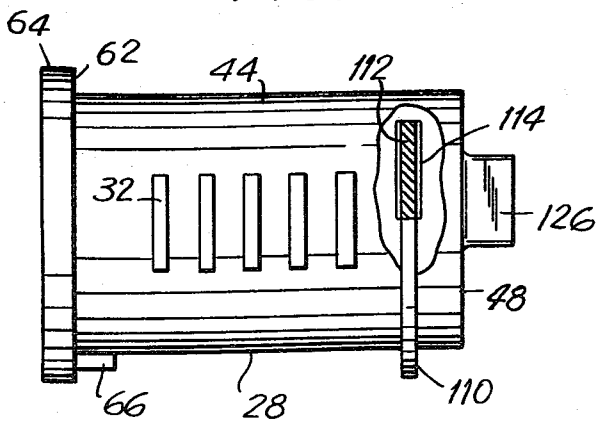
FIG. 4 shows a top view of the cylinder plug.

The present invention will now be described in detail in accordance with the embodiment illustrated in the above-listed drawings.

FIG. 1 illustrates a fragmentary elevational view of a general locking system 10 including a handle 12 rotatably connected to a plate 14, as shown in side elevation in FIG. 2. Plate 14 is in turn secured to a door 16 by four bolts 15. The door may be any door, such as the door of a panel truck. A latch bar 18, which is connected to the handle 12, extends inward and is connected to a latching device (not shown) that latches and unlatches the door to and from a latch hold. A key-activated cylinder lock assembly 20 is positioned within housing 22 integrally disposed on top of handle 12. A locking bolt 24 extends from housing 22 through a plate aperature 23 (FIG. 8) into plate 14, thus locking handle 12 and latch bar 18 into a non-rotatable position so that door 16 cannot be unlatched and opened.

Figure 8:
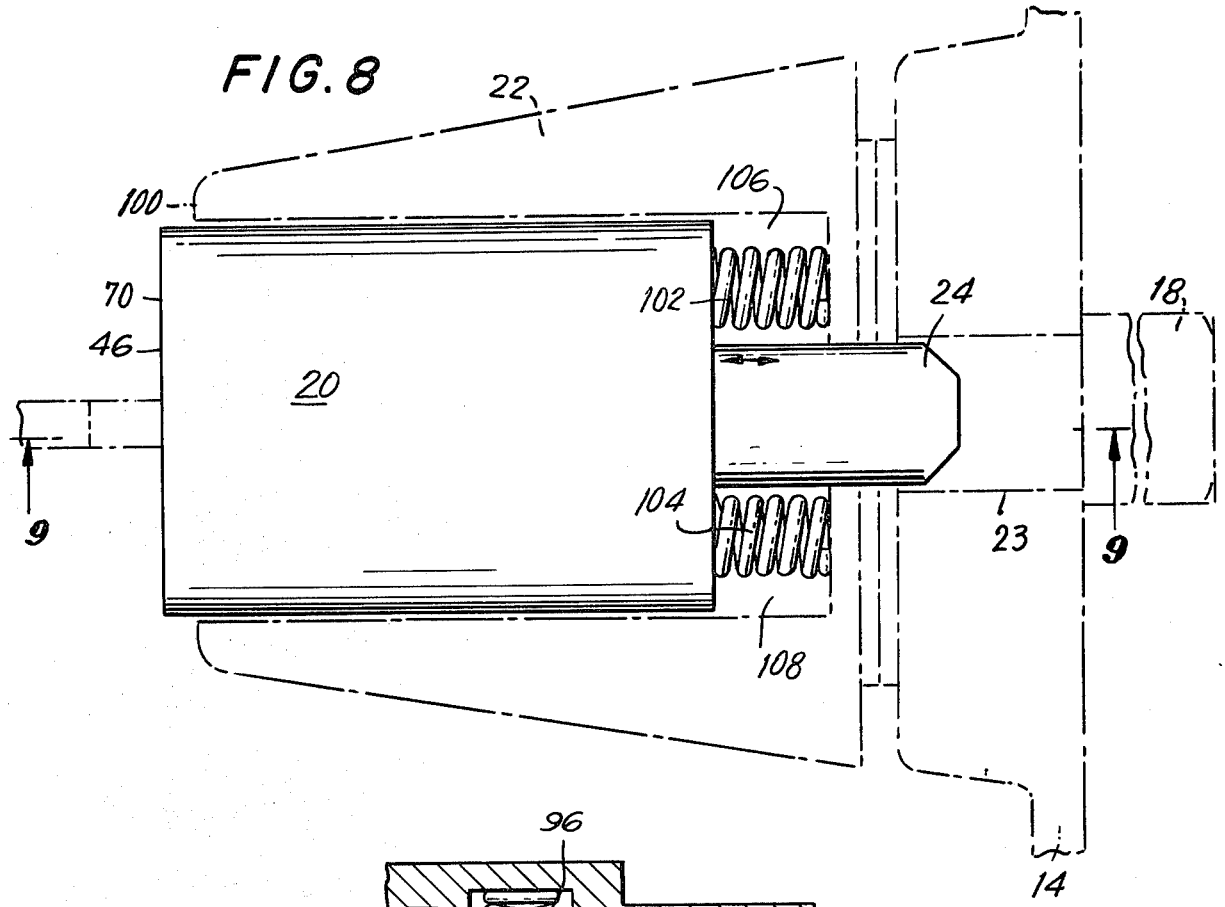
FIG. 8 shows a top view of the cylinder lock with the handle and the plate shown in phantom lines.

FIG. 3 illustrates locking system 10 in an unlocked mode with locking bolt 24 withdrawn from aperature 23 of plate 14. Cylinder lock assembly 20 is shown with a portion of body 26 extended outwardly from housing 22 on the side opposite plate 14 at the same distance as locking bolt 24 has been moved, since, as will be discussed, locking bolt 24 is connected to cylinder lock assembly 20 (as shown in FIG. 8). Locking cylinder plug 28 is shown withdrawn from cylinder body 26 in a manner to be explained. Key 36 is illustrated mounted in locking cylinder plug 28.

Figure 14:
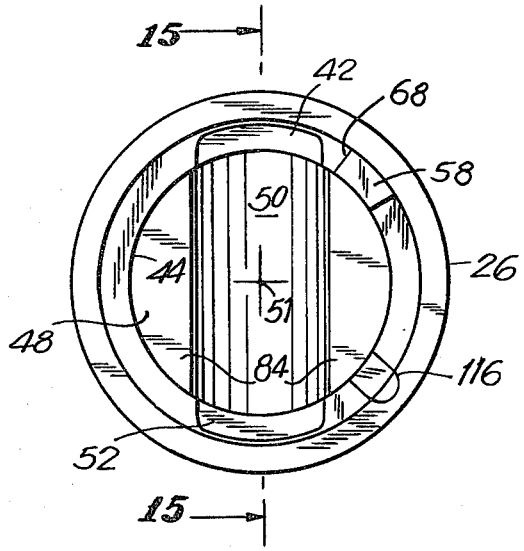
FIG. 14 is an end view of the cylinder body.
Figure 15:
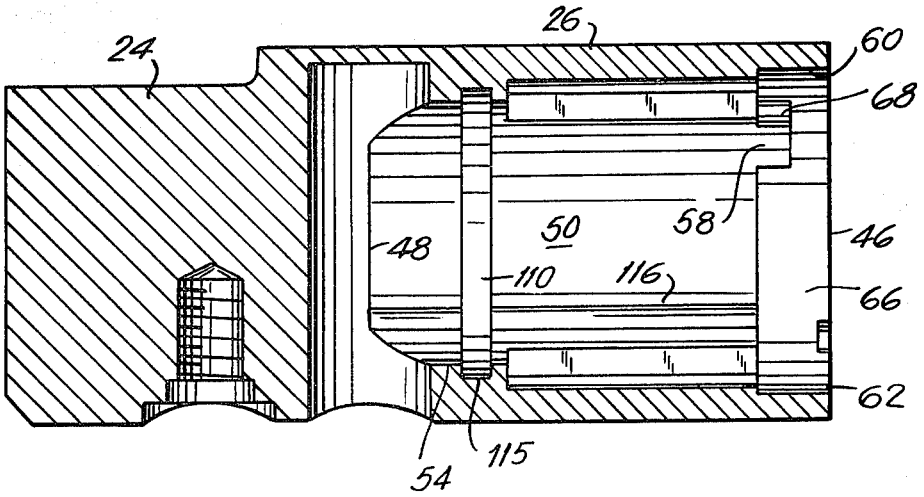
FIG. 15 is a side sectional view taken along line 15—15 in FIG. 14.

FIGS. 14 and 15 illustrate a sectional view of cylinder body 26.

FIGS. 4, 5, 6 and 7 illustrate a top view, a side view, and two end views, respectively, of cylinder plug 28 with key 36 withdrawn.

FIG. 8 shows a top view of cylinder lock assembly 20 with housing 22 and door plate 14 shown in phantom lines, including latch bar 18. Locking bolt 24 is in the locked mode positioned in aperture 23 of plate 14. FIG. 9 illustrates assembly 20 in a side sectional view of FIG. 8 with upper pin tumblers 32 and lower pin tumblers 34 shown in schematic representation. Upper and lower pin tumblers 32 and 34, respectively, are connected, and a compression spring (not shown) raises each pin tumbler 32. As key 36 is inserted into cylinder plug 28, in a manner known in the art, certain ones of the lower tumblers 34, which are of varying lengths are depressed. Five tumblers are illustrated, but this number may of course vary. FIG. 9 further illustrates key 36 (shown in phantom lines) inserted into keyway 38, which is shown in end view of assembly 20 in FIGS. 1 and 6. When key 36 is inserted into keyway 38, grooves 40 of key 38 force pins 32 of plug 38 to withdraw from upper longitudinal groove 42 formed in longitudinal cylindrical wall 44 of cylinder plug 28. Groove 42 extends almost the entire length of chamber 50 formed in cylinder plug 28. Chamber 50 is substantially cylindrical (as shown in FIG. 15). Body 26 is movable in housing 22 approximately in a direction parallel to the axis 51 of cylinder 50.

As is known in the art, upper pin tumblers 32 when in the raised, or locked position, are engaged within upper longitudinal groove 42 until such time as key 36 is placed in the keyway as shown, and key grooves 40 engage to tops of lower pin tumblers 34 and bias the springs of the pin tumblers 32 and pull them down as aforementioned. Key 36 during the actual process of entering into keyway 38 depresses certain ones of lower pin tumblers 34 within plug 28 and causes them to enter lower longitudinal groove 52 formed in wall 44 approximately opposite upper longitudinal groove 42. When key 36 is in its final position with its grooves 40 registering with lower pin tumblers 34, upper pin tumblers 32 are drawn into alignment with outer cylinder wall 44 of cylinder plug 28 and lower pin tumblers have also been depressed into alignment with outer cylinder wall 44. Key 36 can then be turned along with cylinder plug 28 in a clockwise direction.

It is preferred that outer cylindrical wall 44 of cylinder plug 28, which is substantially in sliding contact with inner longitudinal cylindrical wall 54 of body 26. A partially cylindrical step 66 is disposed between outer wall 44 and sealing rim 62. A blocking abutment 58 extends forward into sealing rim 62, as shown in FIG. 15. An inner cylindrical wall 60 in body 26 (of slightly greater diameter than cylindrical wall 54) extends the length of sealing rim 62 from blocking abutment 58, to the outer surface 46 of body 26. Sealing rim 62, which extends outward from outer cylindrical wall 44 of plug 28, is adapted to fit snugly within cylinder body 26 so that the outer surface 64 of the sealing rim 62 fits against the surface of extended inner cylindrical wall 60, as shown in FIG. 9.

When plug 28 is fully positioned in cylinder body chamber 50, and key 36 is inserted into keyway 38, plug 28 can only be rotated clockwise due to cylindrical step 66. In addition, when plug 28, which will be further described, is pulled from or is inserted into chamber 50, it cannot be fully inserted while blocking abutment 58 and cylindrical step 66 are in bearing contact; plug 28 must then be rotated clockwise until thrust portion 66 is free of blocking abutment 58, and is able to be thrust into chamber 50 and seated, as will be described in further detail below.

Blocking abutment 58 of body 26 also forms an inclined plane 68 on the counter clockwise end of portion 58 extending approximately from extended inner cylindrical wall 60 to cylindrical wall 44.

Locking pin 74 biased by spring 96 against inner end 48 of plug 28 and is movable between an upper position 76, as indicated in phantom lines in FIG. 9, and a lower position 78, as shown in FIG. 9. Locking pin 74 is slideably mounted in vertical slot 80 formed in body 26 transverse to plug 28 directly adjoining inner end 48. End 48 includes vertical frames 84 on either side of slot 80. Locking pin 74 is preferably approximately cylindrical and has a flat top side 86 and beveled bottom side 92. When locking pin 74 is in the down position, compression spring 96 is uncompressed and locking pin abuts wall 99 formed in housing 22 immediately below pin 74, so that body 26 cannot be moved longitudinally toward outer housing wall 100 which is substantially parallel to outer and 46 of body 26 and outer wall 70 of plug 28 which are in turn spaced slightly outwards from housing wall 100 as shown in FIGS. 2, 8 and 9, when assembly 20 is in the locked mode. FIG. 8 shows two parallel longitudinal compression springs 102 and 104 in biased position pressuring assembly 20 from spring recesses 106 and 108 formed on either side of housing 22.

A retainer member 110 is connected to plug 28 between tumblers 32 and 34 and inner end 48. Retainer 110 is preferably sem-circular in configuration and is biased outwardly from longitudinal cylinder wall 44 by retainer leaf spring 112 and is movable toward cylinder wall 44 to an outward position in alignment with wall 54. Retainer leaf spring 112 is enclosed in cylindrical enclosure 114 formed by cylinder body 26, as illustrated in the cut away view of FIG. 4. In its spring biased position, retainer member 110 is extended and presses outwards into substantially circular retaining groove 115 formed in longitudinal wall 54 of chamber 50 of body 26. Groove 115 is adapted to engage retainer member 110 as it is biased into the retainer groove.

Figure 13:
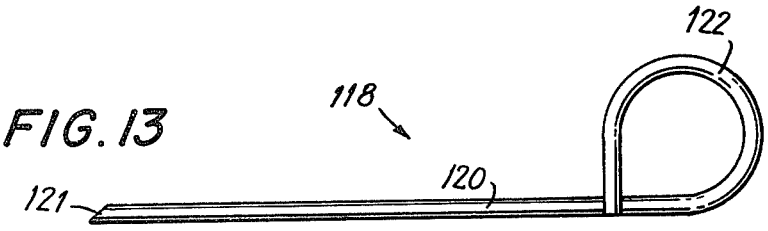
FIG. 13 illustrates the inserting tool.

A longitudinal channel 116 is formed in plug 28 along the periphery to the same depth in the plug as the depth of retainer groove 115. Channel 116 is adapted to receive a wire tool 118, shown in FIGS. 3 and 13, and which includes straight wire portion 120 and loop portion 122 with wire portion 120 having a tip 121 (shown on the opposite end of loop portion 112).

Tool aperture 124 (FIGS. 1, 3 and 10) is formed in sealing rim 62 and is adapted to receive wire portion 120 of tool 118 when aperture 124 is aligned with channel 116. Tool 118 can be inserted through aperture 124, through channel 116, to contact retainer 110 in retainer groove 115. When tip 121 reaches retainer 110 and the loop is turned inwards (counter clockwise) towards keyway 38, retainer 110 can be moved from its unbiased outward position to a biased inward position compressing retainer leaf spring 112 to a cocked position.

Figure 12:
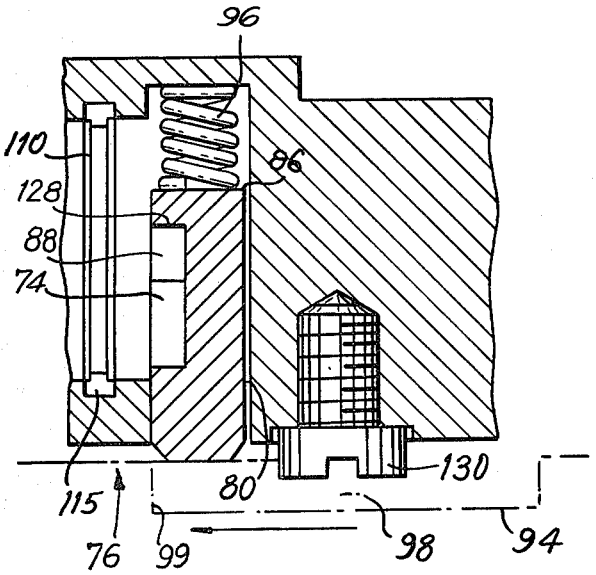
FIG. 12 illustrates a detail of the locking nut with the assembly in the unlocked mode.

A lug 126 extends from inner end 48 of plug 28 (as depicted in FIG. 9). Lug 126 is positioned in locking pin hollow 88, and in particular is positioned closely spaced at the top of hollow 88. In FIG. 8, which illustrates cylinder locking assembly 20 in the locked mode with locking bar 24 of cylinder body 26 positioned in plate aperture 23, key 36 has been inserted into plug 28 causing upper pin tumblers 32 to be withdrawn from upper longitudinal groove 42 of body 26, thus allowing plug 28 freedom to be rotated in a clockwise direction. When key 36 is rotated clockwise, plug 28 also is rotated, and lug 126 comes into bearing contact with the top 128 of hollow 88 of locking pin 74, causing the pin 74 to be lifted upwards past retaining wall 99 to position 76. Longitudinal springs 102 and 104, are compressed when assembly 20 is in the locked mode. When bottom side 92 is lifted upwards from bearing contact with slot 98, longitudinal springs 102 and 104 decompress and press body 26 together with plug 28 horizontally forward towards housing wall 100, thus drawing locking bolt 24 from plate 14 into housing 22. Also wall 70 of plug 28 at end 46 of body 26 is moved a distance away from wall 100 of housing 22. Movement of cylinder body 26 away from plate 14 by longitudinal springs 102 and 104 is checked when screw 130 comes into bearing contact with the wall 99 of slot 98, as is shown in detail in FIG. 12. Movement of body 26 away from plate 14 is terminated by screw 130 being brought into bearing contact with blocking wall 99, to same blocking wall from which locking pin 74 was drawn from bearing contact. Simultaneously outer end 46 of body 26 and outer wall 70 of plug 28 are moved away from wall 100 of the housing as shown in FIG. 3. In this position, the full, normal unlocked mode of cylinder locking assembly 20 is attained.

In accordance with the present invention and as illustrated in FIG. 3, cylinder plug 28 can be withdrawn from cylinder body 26. A user would remove plug 28 at this time rather than in the locked mode. It is noted that in the locked mode, however, the lock can be released by any instrument raising pin 74 once the plug has been removed. In either locked or unlocked positions, the user rotates plug 28 so as to align tool aperture 124 on plug notch 132 to access tool channel 116. Plug notch 132 at outer end 46 of cylinder body 26 is aligned with channel 116, which cannot be seen when plug 28 is positioned in body chamber 50. Once the alignment is made, wire portion 120 of tool 118 is slid into aperture 124 and through channel 116 to retainer member 110. Member 110 is then pried from its outwardly biased position into alignment with longitudinal cylindrical wall 44 of body 26. Simultaneously, key 36 has been placed in the lock so as to draw upper pin tumblers 32 from upper longitudinal groove 42 of cylinder body 26 as to have allowed plug 28 to be rotated so as to align apertures 124 with plug notch 132. With the key as leverage, when retainer 110 has been moved out of retainer groove 115 by tool 118, plug 28 can be slid from cylinder body 26. Retainer 110 is indicated in its withdrawn position in FIG. 3 with tool 118, shown in phantom, still compressing retainer 110 against plug 28. The number of key 36 is preferably marked on the bottom of cylinder plug 28 so as to allow the key and the plug to be matched later.

Figure 5:
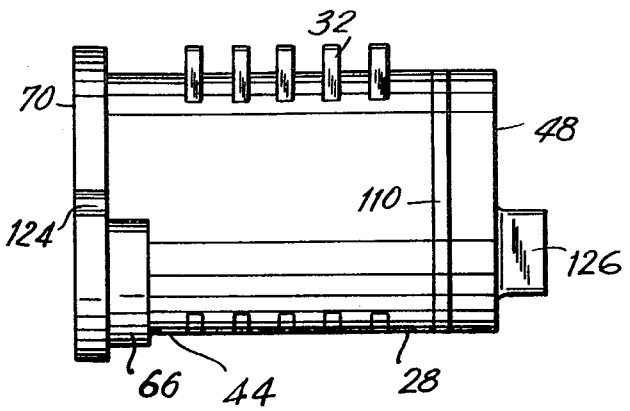
FIG. 5 shows a side view of the cylinder plug.
Figure 7:
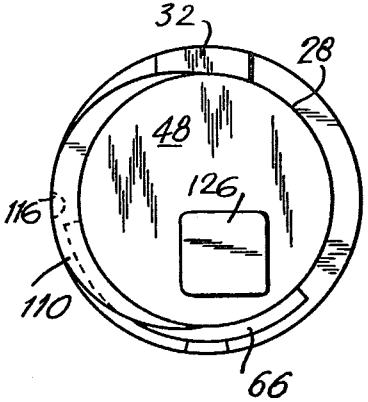
FIG. 7 shows another end view of the plug shown in FIG. 5.
Figure 6:
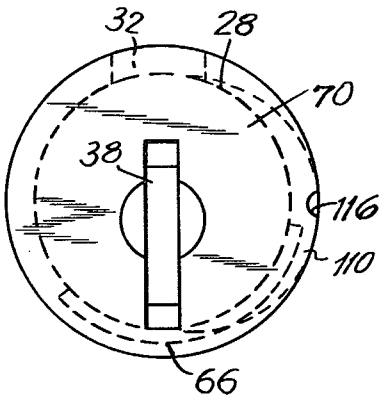
FIG. 6 shows an end view of the plug shown in FIG. 5.

In replacing plug 28, the following procedure is followed. Key 36 is inserted into keyway 38 of plug 28. Plug 28 is then inserted into chamber 50 of cylinder body 26 until resistance is met from the retainer member 110. Plug 28 is then turned clockwise until retainer member 110 meets inclined plane 68. As plug 28 continues to be rotated clockwise, retainer member 110 slides up inclined plane 68 until the diameter of longitudinal cylindrical wall 44 is reached. The clockwise movement of plug 28 is simultaneously pressed inwards, so that when retainer member 110 is moved inwards from its biased position as indicated in FIG. 5 retainer leaf spring 112 is depressed. It is noted that the plug cannot be rotated clockwise, because plug 28 with key 36 still in keyway 38, is not moved fully into cylinder body chamber 50. Until retainer member 110 reaches retainer groove 115 115, at which time retainer member 110 is biased outwards into the groove, plug 28 is not firmly engaged within chamber 50. At this time key 36 is withdrawn and upper pin tumblers 32 are biased into position extending from longitudinal wall 54 of plug 28, so that the plug cannot be turned, since the pins, being in upper groove 42, prevent plug 28 from being rotated by striking against the longitudinal walls of the groove 42.

At this time, handle 12 is rotated to align locking bolt 24 with plane aperture 23 and locking assembly 20 is pressed, causing locking pin 74 to retreat to slot 98, where the pin 74 is forced downwards into engagement with retaining wall 99, thus locking bolt 24 into position. Simultaneously, lug 126 is rotated counter clockwise in locking pin recess 88. Thus, the locking mode of cylinder lock assembly 20 is attached as is the locking mode of the general locking system.

The embodiment of the invention particularly disclosed here is presented merely as an example of the invention. Other embodiments, forms, and modifications of the invention coming within the proper scope of the appended claims will, of course, readily suggest themselves to those skilled in the art. It is particularly noted that the pin tumbler design described here is only one of many pin tumbler designs. Also, for example, the retaining member can be biased by other means than a spring. Also, other methods of bolting can be used.

What is claimed is:

1. A lock assembly movably positionable within a housing and comprising an outer body portion and an inner plug portion substantially concentrically, rotatably disposed within said outer body portion, said plug having a number of tumblers and a keyway for receiving a key for rotatably actuating said tumblers, said plug being removably from said outer body portion only when said outer body portion is disengaged from said housing, said cylinder further comprising:

means defining a groove in said body portion;

a retainer supported by said plug, said retainer actuable for movement into and out of engagement with said groove, said retainer being spring biased into engagement with said groove when said body portion is engaged in said housing;

a flat spring supported by said plug for biasing said retainer into engagement with said groove;

at least one compression spring disposed between said outer body portions and said housing for biasing said outer body portion towards disengagement with said housing;

a slidable pin disposed in said body portion for slidable movement into and out of locking engagement with said housing, said pin normally locking said body portion into engagement with said housing when plug has not been rotatably actuated by said key;

a lug disposed upon said plug for bearing engagement with said pin, said lug causing said pin to move but of normal locking engagement with said housing, when said plug has been rotatably actuated by said key; and means defining a channel disposed between said plug and said body portion, said channel extending to said groove and adapted to receive a tool, for disengaging said retainer from said groove, whereby said plug can be movably freed from said body portion.

2. The lock assembly of claim 1, further comprising a tool for disengaging said retainer from said groove, said tool having an elongated pin for placement in said channel.

3. The lock assembly of claim 2, wherein said tool has means for rotating said tool while said tool is disposed in said channel, said rotation causing said retainer to move out of engagement with said groove.

* * * * *